United States Patent [19]

Lompa-Krzymien

[11] Patent Number: 4,491,454

[45] Date of Patent: Jan. 1, 1985

[54] SULFUR REMOVAL FROM COAL

[75] Inventor: Ludmila Lompa-Krzymien, Gloucester, Canada

[73] Assignee: Canadian Patents and Development Limited, Ottawa, Canada

[21] Appl. No.: 527,500

[22] Filed: Aug. 29, 1983

[51] Int. Cl.[3] ..... C10L 9/02

[52] U.S. Cl. ..... 44/1 SR

[58] Field of Search ..... 44/1 SR; 201/17

[56] References Cited

U.S. PATENT DOCUMENTS 4,127,390 11/1978 Dondelewski ..... 44/1 SR

FOREIGN PATENT DOCUMENTS 943093 3/1974 Canada ..... 44/1 SR

*Primary Examiner*—Carl F. Dees

*Attorney, Agent, or Firm*—Alan A. Thomson

[57] ABSTRACT

Coal is treated to remove both pyritic and organic sulfur by contacting with an aqueous solution comprising cupric ions at temperatures of about 140° C.-200° C. under autogenic pressure, until substantial amounts of the sulfur are solubilized, separating the coal solids, and washing the solids with water to remove soluble forms of sulfur, iron and copper therefrom. The copper can be recovered and recycled as a cupric salt.

14 Claims, No Drawings

SULFUR REMOVAL FROM COAL

This invention is directed to the desulfurization of coal. The coal is treated with a cupric ion solution at elevated temperature and pressure until substantial amounts of sulfur (whether as pyritic or organic sulfur) are solubilized, and the soluble materials removed.

BACKGROUND AND PRIOR ART

Sulfur is present in coal in three forms: as organic sulfur, as pyritic sulfur ($FeS_2$), and as sulfates. Except for highly weathered or oxidized coals, the sulfates represent a negligible amount (less than 0.05%). Organic sulfur predominates in low sulfur coals, and occurs mostly as thiols, sulfides, disulfides and substituted thiophenes. G. R. Hill and L. B. Lyon, Ind. Eng. Chem. 1960, 54, 36. High sulfur coals contain significant amounts of both organic and pyritic sulfur. Pyrite often is present in the form of distinct veins and can be easily removed. For the removal of finely dispersed pyrites and organic sulfur, coal must be refined.

There are basically two groups of desulfurization processes to remedy atmospheric pollution on combustion of sulfur-bearing coal. One group of methods deals with the desulfurization of the combustion gases, the other with the treatment of coal prior to combustion. The latter group can be subdivided into physical (flotation, magnetic cleaning) and chemical methods. These physical methods can remove up to about 90% of the pyritic sulfur. The chemical methods are based on the oxidation or reduction of sulfur. There are several chemical methods of reducing sulfur content by treating coal at elevated temperatures with various gases such as hydrogen, nitrogen, chlorine, ozone, etc. S. Friedman, and Z. I. Warzinsky, Trans ASME, 1976, Paper No. 76-WA/APC-2. E. T. K. Huang and A. H. Pulsifier, "Coal desulfurization during gaseous treatment", ACS Symposium Series, 1977, 64, Coal Desulfurization, 290-304. R. D. Snow, Ind. Eng. Chem. 1932, 24, 903-909. J. C. Agarwal, R. A. Gilberti and P. F. Irminger, Min. Cong. J., 1975, 61, 40-43. Hydrogen, steam and air are very effective for removal of pyritic and organic sulfur from coal at temperatures of 450°-900° C. Reduction in total sulfur in coal is significant but coal undergoes oxidation (mostly $CO_2$ is formed) and heat control in the remaining char is reduced by about 10%.

Other chemical methods are based on the treatment of coal with liquids. Coal has been leached with molten NaOH; KOH (1 to 1 ratio). The caustic is filtered from the coal and the coal is washed with $H_2O$. The method is most efficient at approximately 400° C. Both pyritic and organic sulfur is removed from the coal. There is significant decrease in coal volatile matter and heating value. L. Reggel and R. Raymond, Am. Chem. Soc., Fuel Dv. Preprints, 17:(1), 44, 1972. In another method, coal is digested with a metal oxide such as calcium oxide or sodium oxide in the presence of a fused metal chloride at 400°-600° C. followed by reaction with anhydrous hydrogen chloride (U.S. Pat. No. 3,909,213). U.S. Pat. No. 4,118,200, Oct. 3, 1978, discloses desulfurizing coal in a liquid fused salt bath in the presence of chlorine at about 350°-450° C.

Crushed coal has been mixed with a 10% aqueous solution of sodium hydroxide and a small amount of calcium hydroxide. The mixture is heated under pressure to a temperature of 225°-350° C. for 30 mins. P. X. Mascinatonio, Fuel, 44, 269, 1965. About 95% of the pyrite sulfur and up to 70% of organic sulfur is removed. From 5-10% of coal is dissolved under these conditions.

R. A. Meyers, in a process designed to remove pyritic sulfur (see R. A. Meyers, "Coal desulfurization", M. Dekker Inc., New York and Basel, pages 108-173, 1977, and Canadian Pat. No. 969,883, June 24, 1975) treated crushed coal with a water solution of ferric ions (usually as sulfate) at a temperature of up to 100°-140° C., followed by washing with water and optionally, extraction with an organic solvent to remove free sulfur (and with p-cresol some organic sulfur also). This process results in the removal of up to 90-95% of the pyritic sulfur but in most cases does not remove the organic sulfur. Meyers' method, therefore, is suitable primarily for coals with high pyritic and low organic sulfur content.

It would be desirable to have available a relatively simple and economical way of removing both the pyritic sulfur and the organic sulfur, and lowering the ash content, at the same time.

SUMMARY OF THE INVENTION

In accordance with this invention, up to 100% of both pyritic and organic sulfur are removed by treating coal with an aqueous solution containing cupric ions. It appears that the cupric ions oxidize pyritic sulfur to sulfuric acid and oxidize organic sulfur to water-soluble products.

The invention includes a process of removing sulfur and decreasing the ash content of coal, comprising (a) contacting the sulfur-bearing coal in finely divided form with an aqueous solution containing an effective amount of cupric ions at a temperature of at least about 140° C., under autogenic pressure, until substantial amounts of both pyritic and organic forms of sulfur are solubilized;

(b) releasing the pressure, separating the coal solids from the reaction liquor; and (c) washing the coal solids to remove soluble forms of sulfur, iron and copper therefrom, at least one of the steps (b) and (c) being carried out with oxidative conditions sufficient to provide the Cu and Fe are in cupric and ferric form. In a preferred embodiment, finely divided coal (about 35 mesh) is heated with a 5 wt% water solution of cupric sulfate (or chloride) in a wt ratio of coal/solution of about 1:5, (15-20% solids content in mixture) to about 150°-200° C. until substantially 100% of the sulfur is solubilized, and the coal solids separated and washed.

DETAILED DESCRIPTION

Any coal containing sulfur, especially over about 2% wt sulfur, can be treated by this process. Since the process can remove organic sulfur, coals containing high levels of both pyritic and organic sulfur are most advantageously processed. The coals may be any of anthracites, bituminous coals, lignites, coke, charcoal and other chars, etc. The coal particle size is not critical: most suitably the particle diameter will be within the range of about 0.07 mm up to about 1 cm for the treatment.

The cupric ions are provided from any water soluble cupric salt such as the sulfate, chloride, cuprammonium chloride, nitrate, acetate, citrate or lactate. Cupric ion solutions also may be provided from copper hydrometallurgy processing, e.g. solvent extraction stripping procedures, leach liquors or waste streams (the cupric ion solution need not be pure). Cation exchange resins in the cupric ion form may be exchanged with other cations to provide a cupric ion solution.

Concentration of cupric ions in solution may range from about 0.7% by wt up to saturation, preferably within about 0.9 to about 6% and most preferably about 2-3% based on the solution. When measured as cupric chloride (anhydrous $CuCl_2$) a suitable concentration range is about 2 to about 12% wt preferably about 5%. Approximately the same range would apply for anhydrous $CuSO_4$.

The relative proportion of coal solids to cupric ion solution may vary widely. A preferred range is from about 0.5/10 to about 5/10 by wt. which corresponds to a solids content in the slurry mixture of about 5% to about 40% by wt.

Test results have indicated that a minimum of about 9-10% wt cupric ion based on the coal, normally is required for substantially complete desulfurization of a coal of about 4.5-5% sulfur content. It is preferred to have an excess of cupric ions present to facilitate complete desulfurization. A preferred rule of thumb is to have the % by wt. of cupric ions based on the coal approx. equal to twice the % by wt. sulfur content of the coal.

The temperature during the contacting of coal solids and cupric ion solution should be at least about 140° C. preferably 150°-200° C. The required pressure will be maintained to contain the steam with the contact taking place in any suitable pressure vessel. There normally is no advantage in providing a temperature appreciably above about 200° C. since reaction times are not significantly reduced and costs become excessive.

The contact time to achieve solubilization of substantially all of the sulfur will vary depending on the particle size, sulfur content, cupric ion concentration and temperature. The time can be as short as 0.5-1 hour especially at the higher temperatures.

As soon as the desired degree of solubilization of sulfur has been achieved, the pressure is released. Preferably, air is bubbled through the slurry mixture to oxidize cuprous and ferrous ions to cupric and ferric ions at this point. The coal is separated, e.g. by filtration, centrifugation or settling-decantation, followed by washing with water. At least one wash step is required to remove soluble materials and several wash stages may be used in some cases. Normally oxidative conditions, e.g. free access of air, will be provided for this step. The residual reaction liquor and wash liquids contain sulfur acid and cupric and ferric ions. The concentration of ferric ions in the liquor depends on the pyrite content in coal. If the Fe content is low, the liquor can be reused without separation of ferric ions. If the concentration of ferric ions in the liquor approaches that of cupric ions, the iron should be separated before recycling. This separation can be accomplished by precipitation of ferric hydroxide by increasing the pH of the solution to 2-3. Other methods to recover and recycle cupric ions, if desired, will be evident to those skilled in the art.

Analysis has shown that only small amounts of the carbon, hydrogen and nitrogen and removed by the treatment so that there is no significant loss in heating value of the coal. As well as removing the sulfur, this process also reduces the ash content very significantly.

The following examples are illustrative. The sulfur content in coal was determined using the Shöninger combustion method followed by the volumetric Carius method. Ref.: Steyermark Al "Quantitative Organic Microanalysis", 2nd ed., Academic Press, New York and London, 1961, pp 291-295. This method is recommended by J. N. Chakrabarti to determine the total sulfur content in coal. Ref.: J. N. Chakrabarti, in "Analytical Methods for Coal and Coal Products" Ed. Clarence Karr, Jr., Academic Press, New York, 1978, p 300. The detection limit of the analytical method is one drop of titrant (0.01N $BaCl_2$), which considering the amount of coal used for analysis, corresponds to 0.07% of sulfur. In practice, this means that the samples analyzing 0.07% S contain only trace amounts of sulfur.

Desulfurization was performed on high-sulfur, pulverized (35 mesh) Prince coal from Nova Scotia. Chemical composition of Prince coal is as follows:

| | |
|---|---|
| Proximate analysis: | |
| Moisture | — |
| Volatile matter | 34.62% |
| Ash | 15.64% |
| Fixed carbon (by difference) | 49.78% |
| Ultimate analysis: | |
| Carbon | 65.97% |
| Hydrogen | 4.48% |
| Sulfur | 4.90% |
| Nitrogen | 1.39% |
| Ash | 15.64% |
| Oxygen (by difference) | 7.62% |

The coal used in the experiments contained 4.9% sulfur of which 64% was inorganic and 36% was organic.

EXAMPLE 1

Mixtures of 2 g of this pulverized Prince coal in 10 ml of aqueous solutions of varying concentrations of cupric chloride were placed in glass tubes, sealed, heated and maintained at a temperature of 200° or 150° C. for various periods of time. Precipitation of white crystals of cuprous chloride occurred. With free access to air, the solids were separated from the acidic solution and washed with distilled water until the wash decantant pH was neutral. The coal residue was dried and analyzed for sulfur content. In one test, the coal was subsequently extracted with toluene in a Soxlet apparatus and again analyzed for sulfur content. The solution concentrations were based on anhydrous $CuCl_2$.

The results, which are presented in Table 1, indicate that 100% of the sulfur (pyritic as well as organic) was removed from coal by treating it with an aqueous solution of cupric ions at elevated temperatures. The time required for sulfur removal primarily depended on the concentration of $CuCl_2$ solution and on the temperature. The process was most rapid when carried out at 200° C. At this temperature the reaction was completed in one hour regardless of whether a 5% or 10% solution of cupric chloride was used. At 150° C. the required time was greater. However, conducting the process at the lower temperature could be advantageous technologically.

The solids separated from the reaction mixture required only washing with water to remove the sulfur oxidation products. There was no difference in the sulfur content of treated coal when it was washed with water, or washed with water and extracted with toluene. This indicated that elemental sulfur was not formed during the treatment and only water-soluble sulfur compounds were present in the postreaction mixture. Significantly, expensive extraction with organic solvents can thus be avoided.

TABLE 1

DESULFURIZATION PARAMETERS AND EFFICIENCY

| Concentration of $CuCl_2$ (wt %) | Temperature (°C.) | Duration at Treatment Temperature (hrs) | Post reaction treatment of solids separated from the reaction mixture | Sulfur Content (wt %) | Sulfur removed |
|---|---|---|---|---|---|
| 10 | 200 | 24 | washed with $H_2O$ to pH7 | 0.07* | 100% |
| 10 | 200 | 24 | washed with $H_2O$ to pH7 and extracted with toluene for 4 hrs** | 0.07* | 100% |
| 1 | 200 | 48 | washed with $H_2O$ to pH7 | 3.44 | 29.8% |
| 2 | 200 | 48 | washed with $H_2O$ to pH7 | 0.07* | 100% |
| 10 | 200 | 1 | washed with $H_2O$ to pH7 | 0.07* | 100% |
| 5 | 200 | 1 | washed with $H_2O$ to pH7 | 0.07* | 100% |
| 10 | 150 | 2 | washed with $H_2O$ to pH7 | 3.13 | 36.1% |
| 10 | 150 | 48 | washed with $H_2O$ to pH7 | 0.07* | 100% |
| 5 | 150 | 48 | washed with $H_2O$ to pH7 | 0.07* | 100% |

*0.07 is the detection limit of the analytical method.
**Chemical composition of this desulfurized sample was: C, 68.81; H, 4.39; N, 1.19; Cl, 0.07*; ash, 8.87 (all in wt %).

A sample of the washed (water and toluene) desulfurized coal was analysed and no trace of chlorine was found therefore, chlorination of coal did not take place under the described conditions. This analysis also showed that about 50% of ash in the coal was removed (see ** below Table 1).

EXAMPLE 2

The experiment described above were repeated using cupric sulfate as a desulfirizing agent. Prince coal (about 5% sulfur content) was found to undergo complete desulfurization when maintained with 5% $CuSO_4$ in water at a temperature of 200° C. for one hour (see Table 2).

TABLE 2

| Concentration of $CuSO_4$ (wt %) | Temperature (°C.) | Duration at Treatment Temperature (hrs) | Post reaction treatment of Solids | Sulfur content (wt %) | Sulfur removed |
|---|---|---|---|---|---|
| 2 | 150 | 3 | washed with $H_2O$ to pH7 | 2.85 | 41.7% |
| 5 | 150 | 2 | washed with $H_2O$ to pH7 | 3.43 | 30.0% |
| 5 | 200 | 1 | washed with $H_2O$ to pH7 | 3.78 | 22.8% |
| 5 | 200 | 2 | washed with $H_2O$ to pH7 | 0.07 | 100% |
| 10 | 150 | 1 | washed with $H_2O$ to pH7 | 4.90 | 0% |
| 10 | 150 | 2 | washed with $H_2O$ to pH7 | 3.89 | 20.6% |
| 10 | 200 | 1 | washed with $H_2O$ to pH7 | 0.07 | 100% |
| 10 | 200 | 4 | washed with $H_2O$ to pH7 | 0.07 | 100% |
| 10 | 200 | 4 | * | 0.07 | 100% |
| 10 | 200 | 24 | washed with $H_2O$ to pH7 | 0.07 | 100% |

*After $H_2O$ wash, extracted with toluene for 2 hours.

I claim

1. A process of removing sulfur and decreasing the ash content of coal, comprising
   (a) contacting the sulfur-bearing coal in finely divided form with an aqueous solution containing an effective amount of cupric ions at a temperature of at least about 140° C., under autogenic pressure, until substantial amounts of both pyritic and organic forms of sulfur are solubilized;
   (b) releasing the pressure, separating the coal solids from the reaction liquor; and
   (c) washing the coal solids to remove soluble forms of sulfur, iron and copper therefrom, at least one of the steps (b) and (c) being carried out with oxidative conditions sufficient to provide that Cu and Fe are in cupric and ferric forms.

2. The process of claim 1 wherein the concentration of cupric ions in the aqueous solution in (a) is at least about 0.7% by wt.

3. The process of claim 1 wherein the temperature in (a) is maintained within about 150° to about 200° C.

4. The process of claim 1 wherein the cupric ion concentration in (a) is within about 0.9 to about 6% by wt. and sufficient solution is present to give a slurry of solids content within about 5 to about 40% by wt.

5. The process of claim 1 wherein a minimum of about 9–10% by wt. of cupric ion based on the coal is present in (a).

6. The process of claim 5 wherein there is present in (a) a % by wt. cupric ion based on the coal which is approximately equal to twice the % by wt. sulfur content of the coal.

7. The process of claim 1 wherein the cupric ions are from dissolved cupric sulfate or cupric chloride.

8. The process of claim 1 wherein the aqueous solution in (a) contains from 2 to 10% by wt. cupric sulfate.

9. The process of claim 1 wherein the contact time in (a) is at least about 0.5 hr and both time and temperature selected to give substantially complete sulfur removal.

10. The process of claim 1 wherein the copper is recovered from the reaction liquor and wash liquids and recycled as cupric ions.

11. The process of claim 1 wherein the reaction liquor and wash liquids are treated with avoid iron buildup and recycled to (a).

12. The process of claim 1 wherein the contact in (a) is for about 1 hr at about 200° C. with a cupric sulfate solution of about 5 wt.% concentration at a slurry solids content of about 15–20%.

13. The process of claim 1 wherein before the separation in step (b), air is bubbled through the slurry mixture to provide that Cu and Fe are in cupric and ferric form.

14. The process of claim 1 wherein the washing in step (c) is carried out with free access of air.

* * * * *